US008671620B2

(12) United States Patent
Bourget

(10) Patent No.: US 8,671,620 B2
(45) Date of Patent: Mar. 18, 2014

(54) MOTORIZED SPLIT-HINGE DEVICE FOR A VERY HEAVY DOUBLE DOOR AND VERY HEAVY DOUBLE DOOR EQUIPPED WITH SUCH A DEVICE

(75) Inventor: Christian Bourget, Mezieres-en-Drouais (FR)

(73) Assignee: Baumert, Schaeffersheim (FR)

( * ) Notice: Subject to any disclaimer, the term of this patent is extended or adjusted under 35 U.S.C. 154(b) by 441 days.

(21) Appl. No.: 12/945,238

(22) Filed: Nov. 12, 2010

(65) Prior Publication Data

US 2011/0107675 A1 May 12, 2011

(30) Foreign Application Priority Data

Nov. 12, 2009 (FR) ..... 09 57977

(51) Int. Cl.
*E05F 15/02* (2006.01)

(52) U.S. Cl.
USPC ..... 49/334

(58) Field of Classification Search
USPC ..... 49/333, 334, 335, 337, 338
See application file for complete search history.

(56) References Cited

U.S. PATENT DOCUMENTS

| | | | | |
|---|---|---|---|---|
| 5,101,595 | A * | 4/1992 | Rhoades | 49/28 |
| 6,032,418 | A * | 3/2000 | Larson | 49/333 |
| 6,481,160 | B1 * | 11/2002 | Kowalczyk | 49/335 |
| 7,367,161 | B1 * | 5/2008 | Jones | 49/334 |
| 7,980,151 | B2 * | 7/2011 | Hormann | 74/421 A |
| 2002/0104266 | A1 * | 8/2002 | Ranaudo | 49/334 |
| 2002/0111242 | A1 * | 8/2002 | Balli et al. | 475/149 |
| 2003/0005639 | A1 * | 1/2003 | Kowalczyk | 49/340 |
| 2003/0097793 | A1 * | 5/2003 | Kowalczyk et al. | 49/333 |
| 2010/0005724 | A1 * | 1/2010 | Nicholson | 49/331 |
| 2011/0094160 | A1 * | 4/2011 | Houser | 49/31 |

FOREIGN PATENT DOCUMENTS

| | | | | |
|---|---|---|---|---|
| EP | 0955434 | A2 | 11/1999 | |
| GB | 265388 | * | 2/1927 | |
| GB | 265388 | A | 2/1927 | |
| WO | 9850661 | A1 | 11/1998 | |
| WO | 2007012965 | A1 | 2/2007 | |
| WO | WO 2007012965 | A1 * | 2/2007 | E05F 15/12 |

OTHER PUBLICATIONS

French Search Report, dated Jul. 13, 2010, from corresponding French application.
European Search Report, dated Mar. 5, 2013, from corresponding EP application.

* cited by examiner

*Primary Examiner* — Jerry Redman
(74) *Attorney, Agent, or Firm* — Young & Thompson

(57) ABSTRACT

A motorized split-hinge device for a very heavy double door, designed to be motorized and including a flap that is mounted to pivot around an essentially vertical axis of rotation on a frame, includes a stationary split-hinge part integral with the frame and a movable split-hinge part integral with the flap and mounted in rotation relative to the stationary split-hinge part around a pivoting shaft. The movable split-hinge part includes a drive mechanism driven by a motor unit adapted to drive the movable split-hinge part in rotation around its pivoting shaft and starting the flap moving by pivoting when opening or closing, whereby the motor unit is mounted in a removable manner on the drive mechanism and on a stationary part of the door, and is kept in drive position of the mechanism with anti-rotational locking relative to the flap.

16 Claims, 5 Drawing Sheets

Figure 1:
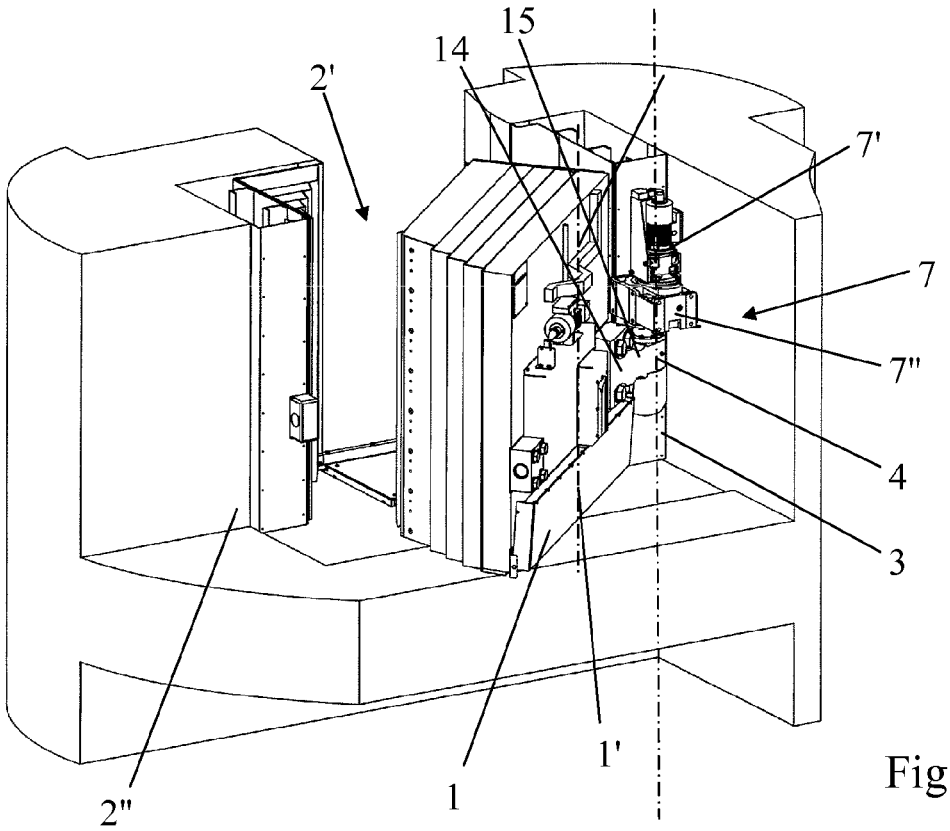

MOTORIZED SPLIT-HINGE DEVICE FOR A VERY HEAVY DOUBLE DOOR AND VERY HEAVY DOUBLE DOOR EQUIPPED WITH SUCH A DEVICE

This invention relates to the field of double doors that are very heavy and that comprise at least one flap or panel that is mounted to pivot on a frame using split-hinges and in particular very heavy double doors that more particularly allow access into hostile environments such as nuclear power plants, and it has as its object a motorized split-hinge device for such very heavy double doors. It also has as its object such a very heavy double door that is equipped with said device.

It is known that the very heavy double doors, weighing several tons, generally consist of a flap or a panel that is very thick and has a heavy load mounted on a frame, around a vertical axis of rotation, using split-hinges that each comprise a pivoting shaft and more particularly a lower split-hinge that supports the bulk of the load of said flap and an upper split-hinge that forms essentially an anti-tilting point and axial guide of said flap.

Such split-hinges generally consist of a movable split-hinge part that is integral with the flap and a stationary split-hinge part that is integral with the frame, whereby said movable split-hinge part is mounted in rotation around the corresponding pivoting shaft relative to said stationary split-hinge part. The movable split-hinge part usually forms a female piece that comprises a bearing that is designed to accommodate the pivoting shaft by sliding or by means of roller bearings, while said pivoting shaft is generally integral with the split-hinge part that is stationary or integrated in the latter, by being oriented upward.

In addition, these very heavy doors usually require the presence of actuators to make possible the movement, by pivoting, when opening or closing the flaps.

However, the hostile environment of a very heavy door, for example in a nuclear power plant building, requires an easy and quick installation and maintenance that cannot be ensured with the current actuators, in particular the arm actuators, as they are used on such very heavy doors. More particularly, they do not allow an interchangeability without a complex and lengthy intervention of the operator.

In addition, the current actuators have a relatively high cost and occupy a large functional volume, which makes their installation difficult, and even impossible, on very heavy doors whose environment is very restricted, which is the case in particular of very heavy doors that are installed in the buildings of nuclear power plants.

The document WO 2007/012965 has as its object a motorized hinge system for door panels or for shutters, in particular made of wood or aluminum, comprising a stationary wing with a hinge pivot, a movable wing, a geared motor attached to a pivoting shaft, integral with the stationary wing, by its upper surface by means of a number of screws, while the drive shaft of the geared motor that is attached to said stationary wing passes through the latter by extending up to a shaft that is integral with the movable wing and that passes coaxially through said pivoting shaft, for the purpose of allowing the drive in rotation of the movable wing around said pivoting shaft.

However, if this type of power unit is suitable for the conventional doors or shutters, the latter is not suitable for the very heavy doors, in particular in hostile environments such as the nuclear power plants that require easy and short maintenance and interchangeability operations. Actually, the attachment of the geared motor to the stationary wing by means of multiple screws ensuring the attachment of the geared motor and its locking in rotation requires specific tools and does not allow an attachment and a rapid release of said geared motor, with minimal constraint. In addition, the attachment of the geared motor under the stationary wing requires that it be held in place while being screwed in, which also adds an additional burden on the operator that makes it very difficult, or even impossible, to change it in such sensitive environments.

This invention has as its object to eliminate these drawbacks by proposing an adaptable motorized split-hinge device on a very heavy door and makes possible an installation and easy and short maintenance or interchangeability interventions, with minimal constraint, and means for actuating the movement of the flap.

For this purpose, this invention has as its object a motorized split-hinge device for a very heavy double door, designed to be motorized and consisting of at least one flap or panel that is mounted to pivot, around an essentially vertical axis of rotation, on a frame, whereby said device comprises a stationary split-hinge part that is integral with said frame and a movable split-hinge part that is integral with said flap and mounted in rotation relative to said stationary split-hinge part around a pivoting shaft, whereby said movable split-hinge part comprises a drive mechanism that is driven by a motor unit, preferably comprising a geared motor, able to drive said movable split-hinge part in rotation around its pivoting shaft and starting said flap moving by pivoting when opening or closing, whereby said motor unit is mounted in a removable manner on said drive mechanism and on the stationary split-hinge part and is characterized essentially in that said motor unit is attached to the stationary split-hinge part using means for quick attachment and release, being kept in drive position of said drive mechanism with anti-rotational locking of said unit relative to the flap, optionally with radial play.

This invention also has as its object a very heavy motorized door and comprises at least one flap or panel that is mounted to pivot, around an essentially vertical axis of rotation, on a frame by means of at least one lower split-hinge and at least one upper split-hinge, said door being very heavy and being characterized essentially in that at least one lower split-hinge consists of a motorized split-hinge device according to this invention.

Figure 2:
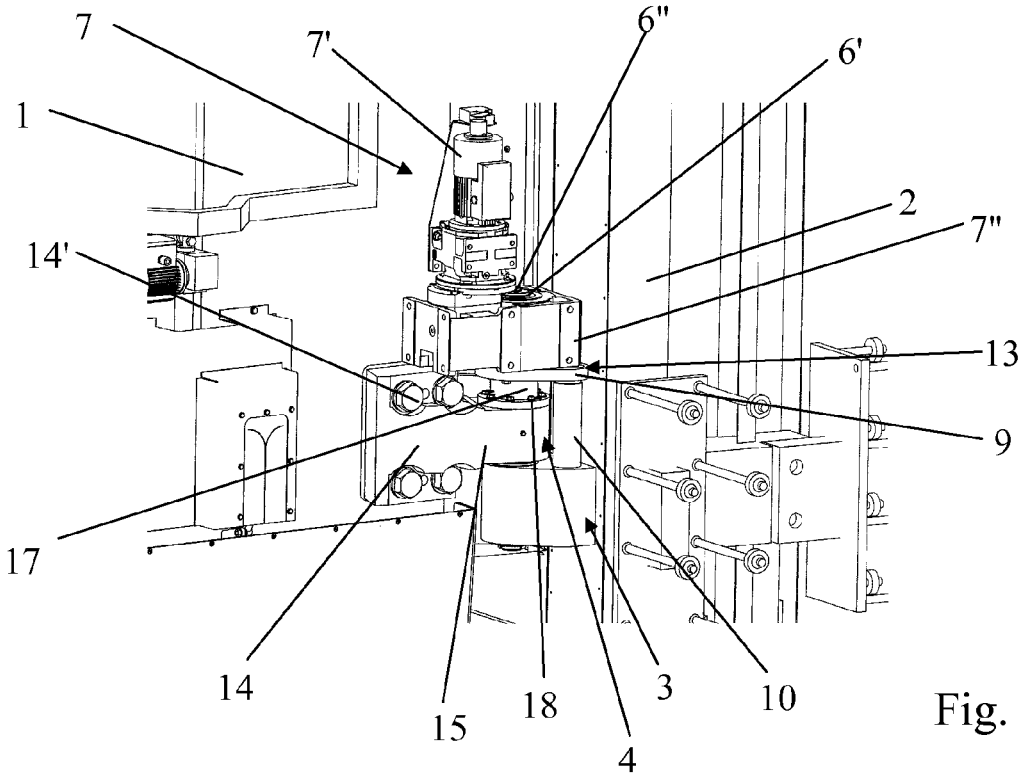
Figure 3:
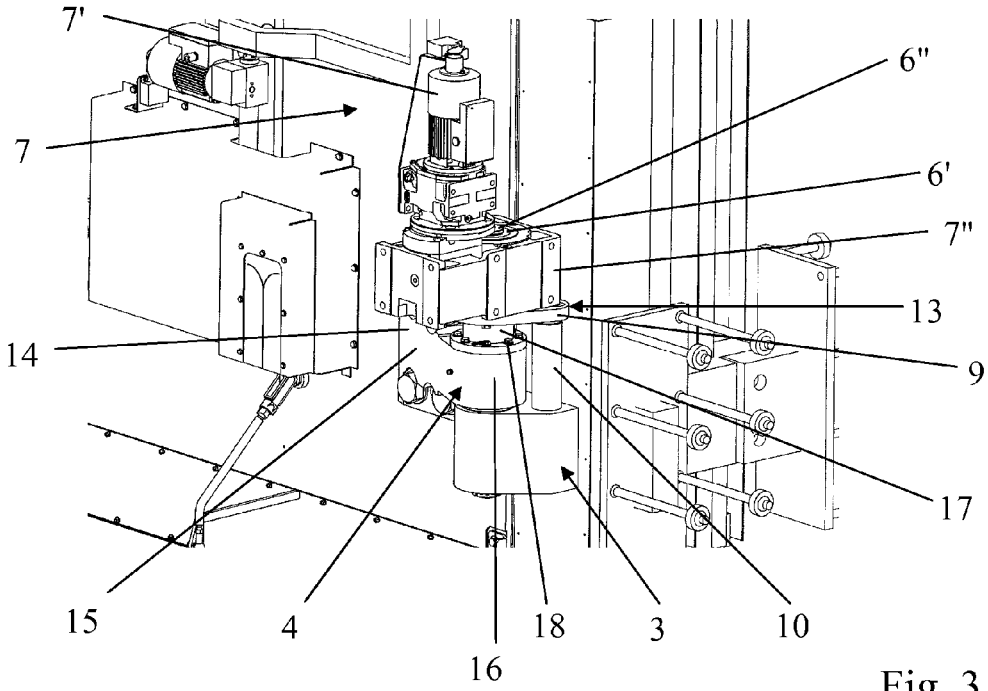
Figure 4:
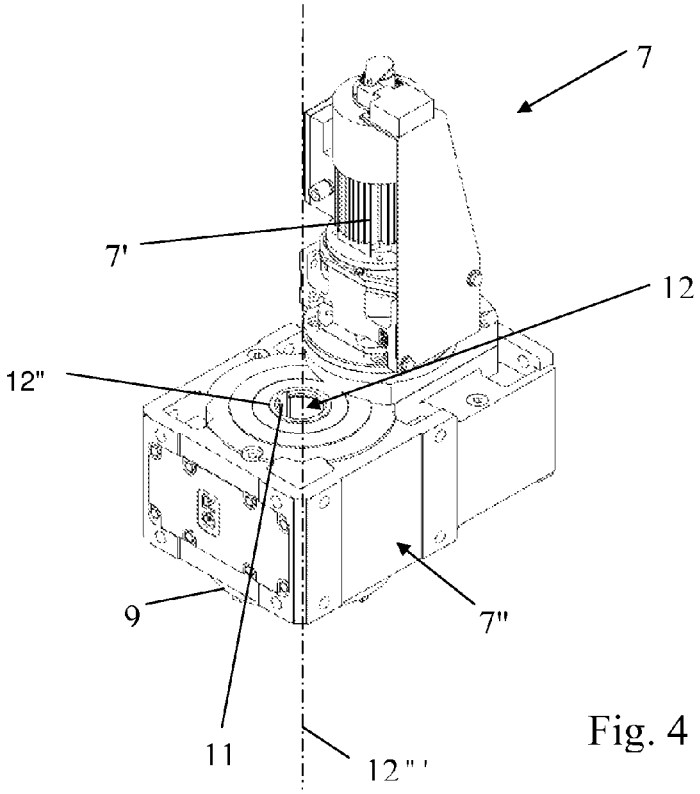
Figure 5:
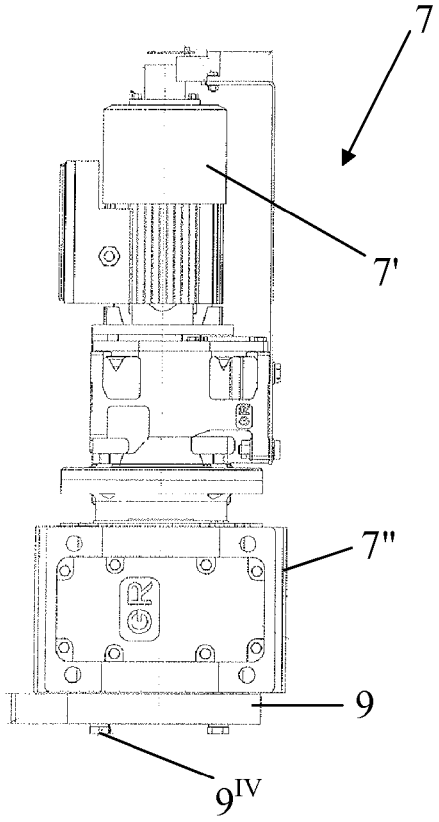
Figure 6:
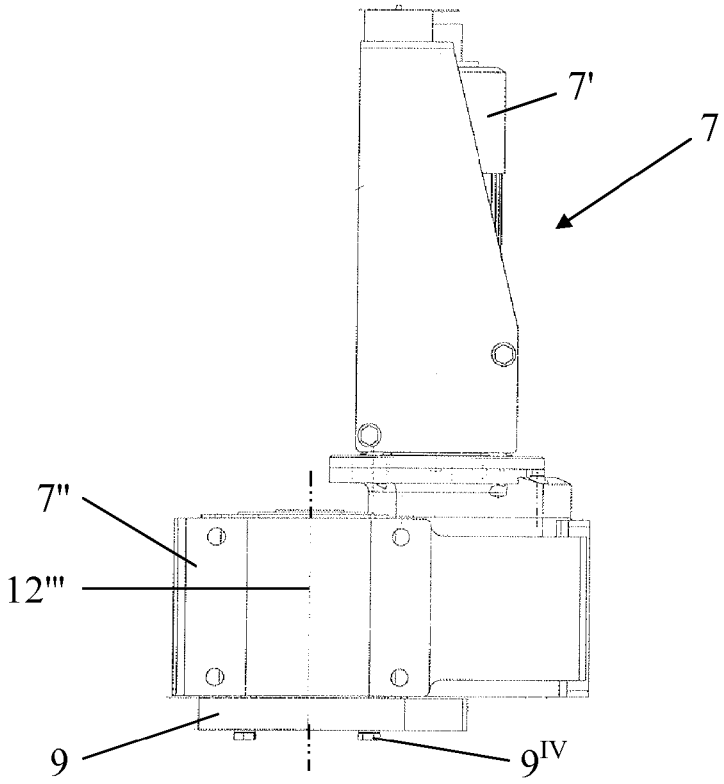
Figure 7:
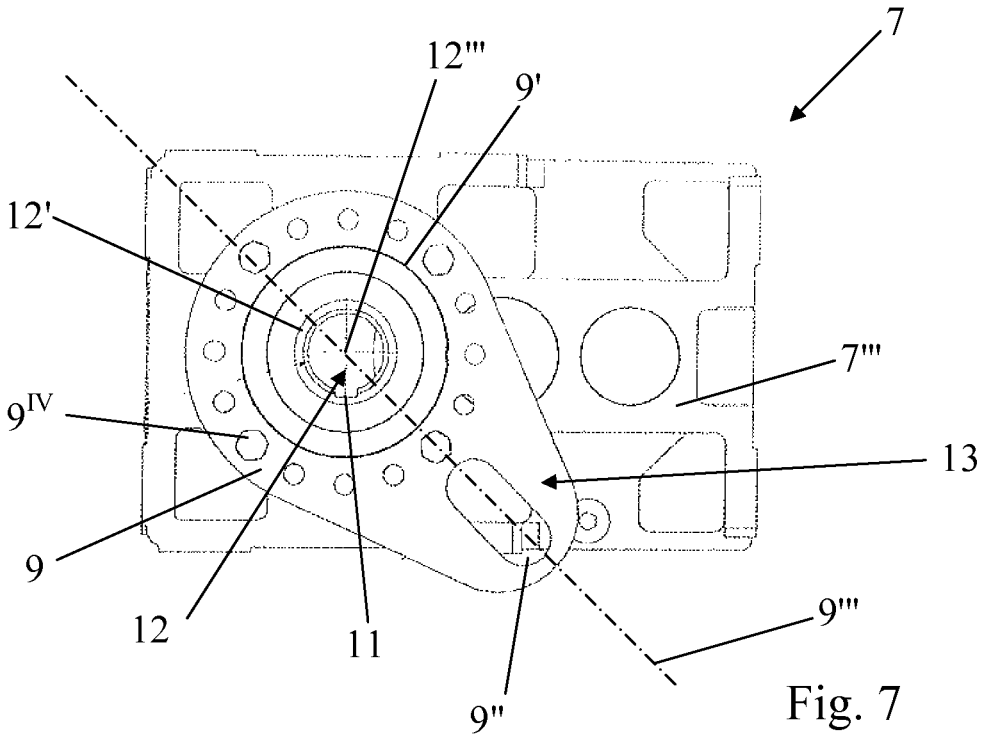
Figure 8:
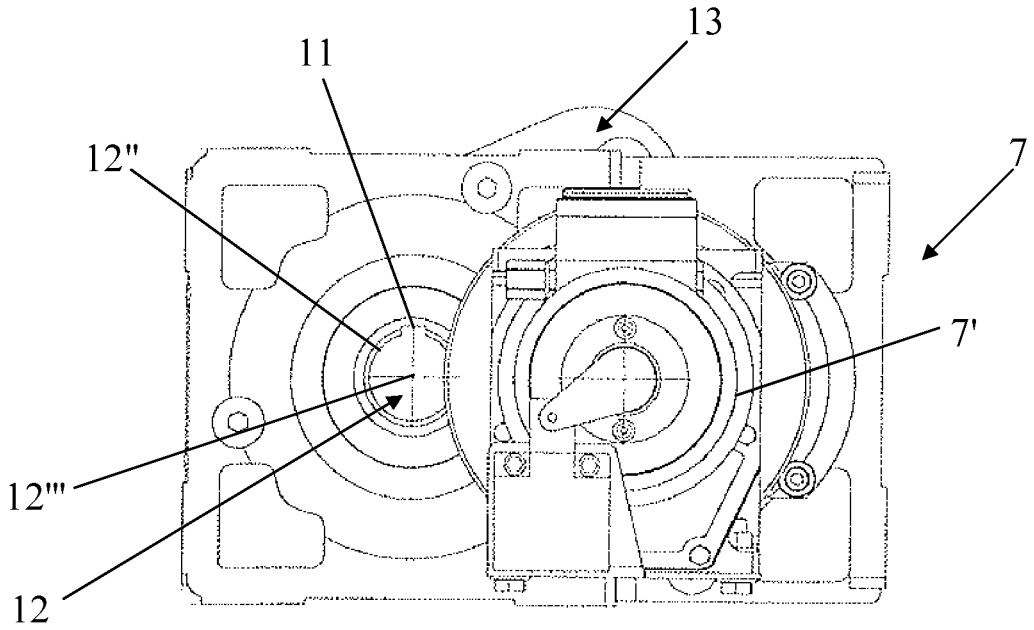
Figure 9:
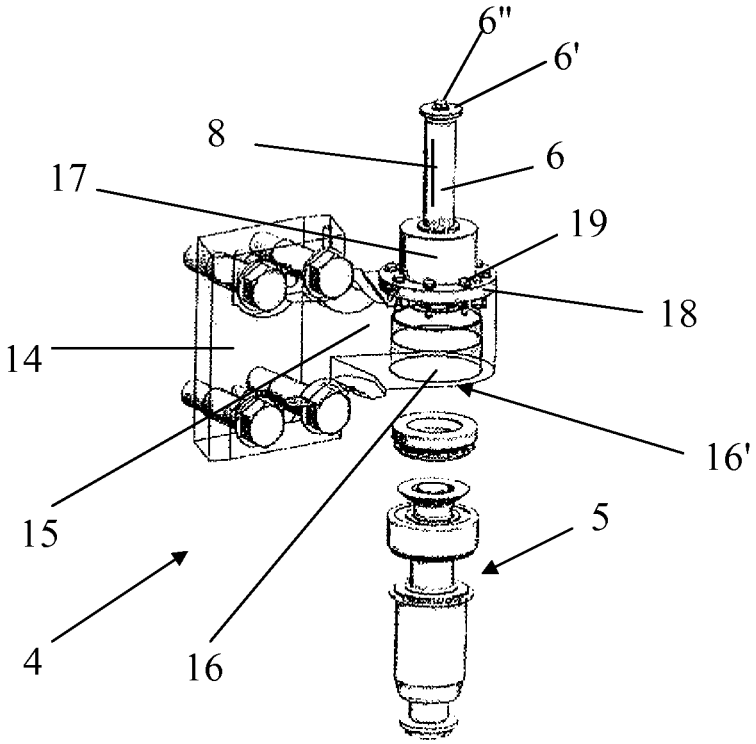

The invention will be better understood using the description below, which relates to a preferred embodiment and is provided by way of nonlimiting example and explained with reference to the accompanying diagrammatic drawings, in which:

FIG. 1 is a perspective view of a preferred embodiment of the motorized split-hinge device according to this invention that is mounted on a very heavy double door that is depicted partially and in the open position, FIG. 2 is a close-up view of the motorized split-hinge device depicted in FIG. 1, FIG. 3 is a close-up view of the motorized split-hinge device depicted in FIG. 1, at a different angle from that of FIG. 2, in a position where the very heavy door is closed, FIG. 4 is a perspective view of the motor unit of the motorized split-hinge device depicted in FIG. 1, FIG. 5 is one surface of the motor unit depicted in FIG. 4, FIG. 6 is a profile view of the motor unit depicted in FIG. 4, FIG. 7 is a bottom view of the motor unit depicted in FIG. 4, FIG. 8 is a top view of the motor unit depicted in FIG. 4, FIG. 9 is an exploded, perspective view of a movable split-hinge part of the device and of the corresponding pivoting shaft of the stationary split-hinge part of the motorized split-hinge device according to this invention that is depicted in FIG. 1.

The accompanying figures show a motorized split-hinge device for a very heavy double door that is designed to be motorized and that consists of at least one flap or panel 1 that is mounted to pivot, around an essentially vertical axis of rotation 1', on a frame 2, whereby said device comprises a stationary split-hinge part 3 that is integral with said frame 2 and a movable split-hinge part 4 that is integral with said flap 1 and is mounted in rotation relative to said stationary split-hinge part 3 around a pivoting shaft 5, whereby said movable split-hinge part 4 comprises a drive mechanism 6, 8 that is driven by a motor unit 7, preferably comprising a geared motor 7', able to drive said movable split-hinge part 4 in rotation around its pivoting shaft 5 and starting said flap 1 moving by pivoting when opening or closing, whereby said motor unit 7 is mounted in a removable manner on said drive mechanism 6, 8 and on the stationary split-hinge part 3.

According to this invention, the motor unit 7 is attached to the stationary split-hinge part 3 using means for quick attachment and release 9, 10, being kept in drive position of said drive mechanism 6, 8 with anti-rotational locking of said unit 7 relative to the flap 1, optionally with radial play.

As can be seen clearly in the accompanying figures, the motor unit 7 can preferably be mounted on the upper surface of the stationary split-hinge part 3 by resting more particularly on the latter.

The motor unit 7 can preferably comprise a drive hub 12, and the drive mechanism can consist of a drive shaft 6 that extends the movable split-hinge part 4, coaxially to its pivoting shaft 5, whereby said drive shaft 6 is driven in axial rotation by said drive hub 12 of the power unit 7 using means for connection and driving in rotation 8, 11 (FIG. 4 and FIG. 9).

Preferably, the means for connection and driving in rotation can consist of one or more keys 8 that are attached to said drive shaft 6, each being attached longitudinally, for example, to the outer surface of said shaft 6 (FIG. 9) and each engaging in a key groove 11 (FIG. 4) made in the drive hub 12 of the motor unit 6, so as to transmit the motor torque to the drive shaft 6 through said corresponding key 8.

It is also possible to see in FIG. 2 and in FIG. 4 that the drive hub 12 that is driven in axial rotation by the geared motor 7' extends by passing through a forward post 7" of the motor unit 7, relative to the part of said unit 7 that comprises the motor part, so as to be able to easily and quickly install said motor unit 7 on the drive shaft 6 of the movable split-hinge part 4.

The forward post 7" can be shaped, preferably as an overall rectangular parallelepiped, so as to have two opposing surfaces, respectively lower and upper, essentially passed through perpendicularly by said drive hub 12 that then empties into said opposing surfaces through two openings, respectively lower opening 12' (FIG. 7) and upper opening 12" (FIG. 4), so as to allow, on the one hand, the introduction of the drive shaft 6 into said drive hub 12, preferably through the lower opening 12', called introduction opening 12' below, and, on the other hand, holding the drive shaft 6 in place with axial locking in said drive hub 12 using a stop 6', such as a washer, attached, for example by means of a screw 6", and therefore by nature in a removable way, on the part of the free end of said drive shaft 6 that projects from the opposing surface and comes to rest against the outer surface of said face (FIG. 2), preventing any withdrawal of said drive shaft 6 from the drive hub 12.

Preferably, the motor unit 7 can advantageously be secured, in a removable manner, with anti-rotational locking, on the stationary split-hinge part 3 by means of a connection piece 9 that is attached to said motor unit 7 and that comprises a connection part 13 that ensures the mechanical connection with said stationary split-hinge part 3 by means of a connecting and anti-rotational locking shaft or pin 10 attached to the latter, whereby the mechanical connection between the connection part 13 and said pin is preferably a mechanical connection with radial play that can impart a degree of freedom to said unit 7, allowing possible movements and a small size of the unit during the opening or closing of the flap 1 (FIG. 2, FIG. 3, FIG. 7 and FIG. 8).

The connection piece 9 that accommodates the connecting and anti-rotational locking pin 10 for the purpose of allowing the removable attachment of the motor unit 7, while preventing the rotation of said unit relative to the flap 1, on a stationary part of the frame 2 and more particularly on the stationary split-hinge part 3 as well as the drive shaft 6 that extends the movable split-hinge part 4 for the purpose of its insertion into the hub 12 of the motor unit 7, makes it quick and easy to change the latter, unlike the current system, which does not comprise such means for attachment and rapid release of said unit both on the movable split-hinge part and on the stationary split-hinge part.

In a preferred embodiment of this invention, the connection piece 9 can be attached advantageously under the motor unit 7 and partially opposite the introduction opening 12' of the motor unit 7 (FIG. 7 and FIG. 8).

It will then be understood that the connection part 13 constitutes a lateral extension of the part of the connection piece 9 that is located opposite said introduction opening 12'.

This invention can ensure that the connecting and anti-rotational locking pin 10 has an elongated shape, preferably cylindrical overall, and is connected mechanically by one of its free ends to the connection part 13 of the connection piece 9 and attached by its other free end to the outer surface of the stationary split-hinge part 3 by extending essentially parallel to the axis of rotation 1' of the flap 1, separately from the movable split-hinge part 4.

Preferably, the stationary split-hinge part 3 can have an overall cylindrically-shaped structure with an essentially vertical axis, and the connecting and anti-rotational locking pin 10 can be attached to the upper surface of said stationary split-hinge part 3 by extending essentially perpendicular to the latter, as can be seen in particular in FIG. 2 and in FIG. 3.

Preferably, as can be seen in FIG. 7, the connection piece 9 can be produced in the form of a plate that is attached under the motor unit 7 and partially opposite the introduction opening 12' of the drive shaft 6 in the drive hub 12. Said connection piece 9 in the form of a plate can extend advantageously in a plane that is essentially perpendicular to the shaft 12''' of the drive hub 12 and can comprise, on the one hand, a first slot 9' that said drive shaft 6 of the movable split-hinge part 4 can pass through for the purpose of making possible the mechanical connection in driving said drive shaft 6 with said drive hub 12, and, on the other hand, a second slot 9" that can accommodate a part of the corresponding free end of the connecting and anti-rotational locking pin 10 (FIG. 4) for the purpose of ensuring the mechanical connection of said connection piece 9 with said pin 10 so as to ensure an anti-rotational locking of the motor unit 7, in particular around the shaft 12''' of the drive hub 12.

If reference is made to FIG. 7 and to FIG. 8, it can be seen that the connection piece 9 in the form of a plate is attached under the motor unit 7 using screws $9^{IV}$, preferably distributed around the first opening 9', making it possible to tighten said connection piece 9 against the lower surface 7''' of said motor unit 7.

The connection piece 9, attached to the motor unit 7 and connected mechanically to the connecting and anti-rotational locking pin 10 that is integral with a stationary point of the very heavy door in question and preferably of the stationary split-hinge part 3, is thus locked in rotation around the shaft 12''' of the drive hub 12, which has the effect of preventing any rotation of said motor unit 7, in particular around said shaft 12'''.

It will be understood that in the operating mode, when the geared motor 7' is powered, the latter is able to drive the drive hub 12, which then drives in axial rotation the drive shaft 6 that is preferably cottered and integral with the movable split-hinge part 4, and, when opening or closing, starting the pivoting of the flap 1 that is integral in rotation with said movable split-hinge part 4.

It will also be understood that a removable motor unit 7 that is used in the split-hinge device according to this invention is held, with anti-rotational locking, in a position of driving in rotation of the movable split-hinge part 4 and starting from the flap 1 of the very heavy door in question, on the one hand, by being operationally installed on the drive shaft 6 that is integral in rotation with the movable split-hinge part 4, and, on the other hand, by being locked in rotation around the shaft 12''' of the drive hub 12 by means of the connection piece 9 that accommodates the connecting and anti-rotational locking pin 10 that is integral with the stationary split-hinge part 3.

In contrast, this invention can advantageously ensure that the second slot 9" has an oblong shape, with a longitudinal axis 9''' that passes essentially via the shaft 12''' of the drive hub 12 of the motor unit 7, preferably with a width that is approximately equal to the diameter of the part of the corresponding free end of the overall cylindrical connecting and anti-rotational locking pin 10 that passes through it. Said part of the free end that passes through said second oblong slot 9" is able to slide freely into the latter so as to impart to it a radial play or a degree of freedom of radial movement in the direction of the length of said second oblong slot 9" (FIG. 7) that makes it possible to allow possible radial movements and a small size of said motor unit 7 during the opening or closing of the flap 1.

Finally, this invention can ensure that the pivoting shaft 5 can be integral with the stationary split-hinge part 3 and that the movable split-hinge part 4 can consist of a support plate 14 that is designed to be attached to the flap 1, for example using screws 14', and extending via an arm 15 that carries—at its free end—an end fitting 16, preferably of an overall cylindrical shape, comprising a receiving cavity or bearing 16' that is designed to accommodate the pivoting shaft 5 of the movable split-hinge part 4 (FIG. 2, FIG. 3, and FIG. 9).

In addition, the arm 15 can advantageously extend by moving away from the plane of the flap 1, as can be seen, for example, in FIG. 3, so as to create a space or sufficient disengagement that makes it possible to house and to use the motor unit 7, while the pivoting shaft 5 can advantageously be mounted on the stationary split-hinge part 3 (FIG. 2 and FIG. 3).

Preferably, the drive shaft 6 of the movable split-hinge part 4 can be attached to the upper surface of the end fitting 16 by means of a hood 17 with an overall cylindrical shape that comprises an enlarged base that forms an attachment ring 18 for its connection with locking in rotation on said end fitting 16, preferably by screwing said ring 18 onto said upper surface of the latter, and more particularly by screwing in screws 19 that are spaced uniformly over the entire circumference of said ring 18 (FIG. 2, FIG. 3, and FIG. 9).

This invention also has as its object, as can be seen in particular in FIG. 1, a very heavy motorized door that comprises at least one flap or panel 1 that is mounted to pivot, around an essentially vertical axis of rotation 1', on a frame 2 by means of a lower split-hinge 3, 4 and at least one upper split-hinge, not shown, of which at least one lower split-hinge 3, 4 consists of a motorized split-hinge device according to this invention.

In addition, this invention can ensure a preferred arrangement in which the motor unit 7 can advantageously occupy a space that is adjacent to said frame 2, at the axis of rotation 1' of the flap 1, between the lower split-hinge(s) 3, 4 and the upper split-hinge(s) of said door, i.e., essentially within the alignment of the respectively lower and upper split-hinges, for the purpose of ensuring a limited space requirement on the part of the motor unit and an implementation at a location that does not require any work to be done in the frame or in the slab that houses said door. Such an arrangement thus perfectly meets the constraints that are linked to the restricted, and even hostile, environment of such a door, and in particular a door that allows access to a closed space in a nuclear power plant building.

It will be noted that in such a motorized split-hinge device that consists of at least one lower split-hinge, the guiding in rotation of the movable split-hinge part 4 relative to the stationary split-hinge part 3 of each so-called lower split-hinge, around its pivoting shaft 5, can advantageously be produced by insertion of radial roller bearing means that are designed primarily to support the radial loads and axial roller bearing means that are designed to support primarily axial loads, whereby said roller bearing means are able to allow an angular lack of coaxiality on the part of said stationary split-hinge part relative to said movable split-hinge part, as is described in the French Patent Application No. 09 57975 in the name of this applicant.

In the latter case and for a very heavy door that comprises at least one upper split-hinge, each so-called upper split-hinge, according to the above-mentioned French patent application, can advantageously comprise radial roller bearing means that are designed to support primarily the radial loads and that are able to allow an angular lack of coaxiality on the part of its stationary split-hinge part relative to its movable split-hinge part.

Of course, the invention is not limited to the embodiment described and depicted in the accompanying drawings. Modifications are possible, in particular from the standpoint of the composition of various elements or by substitution of equivalent techniques, without thereby exceeding the field of protection of the invention.

The invention claimed is:

1. A motorized split-hinge device for a door that includes a flap (1) that is mounted to pivot around an essentially vertical axis of rotation (1') on a frame (2), the device comprising:

a stationary split-hinge part (3) that is integral with said frame (2) and a movable split-hinge part (4) that is integral with said flap (1) and is mounted in rotation relative to said stationary split-hinge part (3) around a pivoting shaft (5), said movable split-hinge part (4) comprising a drive mechanism (6, 8) that is driven by a motor unit (7) able to drive said movable split-hinge part (4) in rotation around said pivoting shaft (5), said motor unit (7) being mounted in a removable manner on said drive mechanism (6, 8) and on the stationary split-hinge part (3), and attached to the stationary split-hinge part using means for quick attachment and release (9, 10), and being kept in a drive position of said drive mechanism (6, 8) with anti-rotational locking of said motor unit (7) relative to the flap (1), wherein the motor unit (7) comprises a drive hub (12), and wherein the drive mechanism comprises a drive shaft (6) that extends the movable split-hinge part (4) coaxially to said pivoting shaft (5), and means for connection and driving in rotation (8, 11) that drives, through said drive hub (12), said drive shaft (6) in axial rotation, and wherein the drive hub (12) passes through a forward post (7") of the motor unit (7) and has two opposing lower and upper surfaces, passed through perpendicularly by said drive hub (12) that opens onto said two opposing lower and upper surfaces through two openings, respectively lower opening (12') and upper opening (12"), so as to allow introduction of the drive shaft (6) into said drive hub (12) through the lower opening (12'), and holding the drive shaft (6) in place with axial locking in said drive hub (12) using a stop (6') that is attached in a removable way to the part of the free end of said drive shaft (6) that projects from the upper opening and comes to rest against the upper surface, preventing withdrawal of said drive shaft (6) from said drive hub (12).

2. The device according to claim 1, wherein the means for connection and driving in rotation comprises one or more keys (8) that are attached to the drive shaft (6) and that each engage in one key groove (11) made in the drive hub (12) of the motor unit.

3. The device according to claim 1, wherein the forward post (7") of the motor unit (7) is a rectangular parallelepiped.

4. The device according to claim 1, wherein the motor unit (7) is attached in a removable manner to the stationary split-hinge part (3) by means of a connection piece (9) that is attached to said motor unit (7) and that comprises a connection part (13) that ensures the mechanical connection with the stationary split-hinge part (3) by means of a connecting and anti-rotational locking pin (10) attached to the stationary split-hinge part (3).

5. The device according to claim 4, wherein the connection piece (9) is attached under the motor unit (7), and wherein the connecting and anti-rotational locking pin (10) has an elongated cylindrical shape and has a first free end connected mechanically to said connection piece (9) and a second free end attached to the stationary split-hinge part (3) by extending essentially parallel to the axis of rotation (1') of the flap (1), separately from the movable split-hinge part (4).

6. The device according to claim 5, wherein the stationary split-hinge part (3) has a cylindrically-shaped structure with an essentially vertical axis, and wherein the connecting and anti-rotational locking pin (10) is attached to said stationary split-hinge part (3).

7. The device according to claim 4, wherein the connection piece (9) is generally flat and is attached under the motor unit (7), and extends in a plane that is essentially perpendicular to the drive shaft (12') of said drive means (12), said connection piece (9) comprising a first slot (9') that is passed through by said drive shaft (6) of the movable split-hinge part (4) for the purpose of allowing the mechanical connection of driving said shaft (6) in said hub (12), and a second slot (9") that accommodates a portion of a corresponding free end of the connecting and anti-rotational locking pin (10) for the purpose of ensuring the mechanical connection of said connection piece (9) with the latter, so as to ensure an anti-rotational locking of the motor unit (7).

8. The device according to claim 7, wherein the second slot (9") has an oblong shape with a longitudinal axis (9'") that passes essentially via the drive shaft (12') of the drive hub (12) of the motor unit (7), and wherein the part of the corresponding free end of the connecting and anti-rotational locking pin (10) that passes through said second slot is able to slide freely into the latter so as to impart to it radial play in the direction of the length of said second slot (9") that makes it possible to allow radial movements during movement of the flap (1).

9. The device according to claim 1, wherein the pivoting shaft (5) is integral with the stationary split-hinge part (3), and wherein the movable split-hinge part (4) comprises a support plate (14) that is attached to the flap (1) and that extends by an arm (15) that carries at its free end an end fitting (16), with a cylindrical shape, the pivoting shaft comprising a receiving cavity (16') that said pivoting shaft (5) of said movable split-hinge part (4), and wherein said arm (15) extends by moving away from the flap (1) so as to create sufficient space to house the motor unit (7).

10. The device according to claim 9, wherein the drive shaft (6) of the movable split-hinge part (4) is attached to the end fitting (16) by means of a hood (17) with a cylindrical shape comprising an enlarged base that forms an attachment ring (18) for its connection with locking in rotation on said end fitting (16).

11. The device according to claim 1, wherein the door further includes a lower split-hinge and an upper split-hinge, and wherein at least one of the lower split-hinge and the upper split-hinge is the motorized split-hinge device.

12. The device according to claim 11, wherein the motor unit (7) occupies a space that is adjacent to the frame (2), between the lower split-hinge and the upper split-hinge.

13. The device according to claim 12, wherein rotation of the movable split-hinge part relative to the stationary split-hinge part around the pivoting shaft is guided by a radial roller bearing that supports radial loads and an axial roller bearing that supports axial loads.

14. The device according to claim 11, wherein rotation of the movable split-hinge part relative to the stationary split-hinge part around the pivoting shaft is guided by a radial roller bearing that supports radial loads and an axial roller bearing that supports axial loads.

15. A motorized split-hinge device for a door that includes a flap (1) that is mounted to pivot around an essentially vertical axis of rotation (1') on a frame (2), the device comprising:

a stationary split-hinge part (3) that is integral with said frame (2) and a movable split-hinge part (4) that is integral with said flap (1) and is mounted in rotation relative to said stationary split-hinge part (3) around a pivoting shaft (5), said movable split-hinge part (4) comprising a drive mechanism (6, 8) that is driven by a motor unit (7) able to drive said movable split-hinge part (4) in rotation around said pivoting shaft (5), said motor unit (7) being mounted in a removable manner on said drive mechanism (6, 8) and on the stationary split-hinge part (3), and attached to the stationary split-hinge part using means for quick attachment and release (9, 10), and being kept in a drive position of said drive mechanism (6, 8) with anti-rotational locking of said motor unit (7) relative to the flap (1), wherein the motor unit (7) comprises a drive hub (12), and wherein the drive mechanism comprises a drive shaft (6) that extends the movable split-hinge part (4) coaxially to said pivoting shaft (5), and means for connection and driving in rotation (8, 11) that drives, through said drive hub (12), said drive shaft (6) in axial rotation, wherein the motor unit (7) is attached in a removable manner to the stationary split-hinge part (3) by means of a connection piece (9) that is attached to said motor unit (7) and that comprises a connection part (13) that ensures the mechanical connection with the stationary split-hinge part (3) by means of a connecting and anti-rotational locking pin (10) attached to the stationary split-hinge part (3), and wherein the mechanical connection between the connection part (13) and the connecting and anti-rotational locking pin (10) is a mechanical connection with radial play that imparts a degree of freedom to said motor unit (7).

16. The device according to claim 15, wherein the connection piece (9) is attached under the motor unit (7), and wherein the connecting and anti-rotational locking pin (10) has an elongated cylindrical shape and has a first free end connected mechanically to said connection piece (9) and a second free end attached to the stationary split-hinge part (3) by extending essentially parallel to the axis of rotation (1') of the flap (1), separately from the movable split-hinge part (4).

* * * * *